United States Patent [19]

Sherrill

[11] Patent Number: 5,056,240

[45] Date of Patent: Oct. 15, 1991

[54] OVERSHOES FOR PROTECTING CLEAN FLOORS FROM SOILED SHOES OR BOOTS

[76] Inventor: William T. Sherrill, 1302 E. Wendover Ave., Greensboro, N.C. 27405

[21] Appl. No.: 354,823

[22] Filed: May 22, 1989

[51] Int. Cl.[5] ..... A43B 3/16

[52] U.S. Cl. ..... 36/7.3; 36/7.1 R; 36/72 R; 36/138

[58] Field of Search ..... 36/7.1 R, 7.2, 7.4, 36/7.7, 8.1, 11.5, 72 R, 7.3, 138

[56] References Cited

U.S. PATENT DOCUMENTS

| | | | |
|---|---|---|---|
| D. 14,774 | 2/1884 | Preston | 36/7.3 X |
| 270,964 | 10/1983 | Archibald . | |
| 2,901,840 | 9/1959 | Ferguson | 36/7.1 R |
| 3,283,423 | 11/1966 | Schovee | 36/138 X |
| 3,299,540 | 1/1967 | Scholl | 36/8.1 |
| 3,621,592 | 11/1971 | Goldmerstein | 36/138 |
| 3,718,993 | 3/1973 | Schovee . | |
| 3,800,446 | 4/1974 | Pass | 36/7.1 R |
| 4,489,509 | 12/1984 | Libit | 36/7.1 R |
| 4,704,810 | 11/1987 | Massengale | 36/7.1 R X |
| 4,779,360 | 10/1988 | Bible | 36/7.7 |

FOREIGN PATENT DOCUMENTS

| | | | |
|---|---|---|---|
| 2578725 | 9/1986 | France | 36/7.1 R |
| 374479 | 8/1939 | Italy | 36/7.1 R |

*Primary Examiner*—Paul T. Sewell

*Attorney, Agent, or Firm*—Bell, Seltzer, Park & Gibson

[57] ABSTRACT

The present invention is related to an overshoe for receiving a shoe or boot that has mud or dirt thereon so as to permit a person entering a house or other clean environment to enter without depositing mud therein. The overshoe includes a sole with an upper portion for overlying the toe of the shoe. The overshoe further includes an upstanding lip attached to the edges at the heel to retain mud or dirt inside the overshoe while further providing a large generally opened heel arrangement to permit easy insertion and retraction of a shoe or boot. The overshoe further includes tabs at the forward and rearward ends thereof to provide means for restraining the overshoe to easily remove and attach it in a hands free manner.

8 Claims, 1 Drawing Sheet

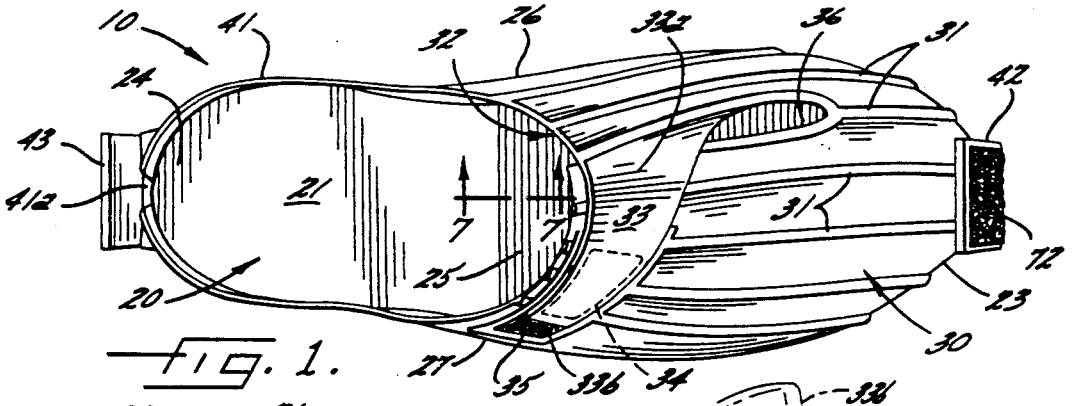
Fig. 1.
Fig. 7.
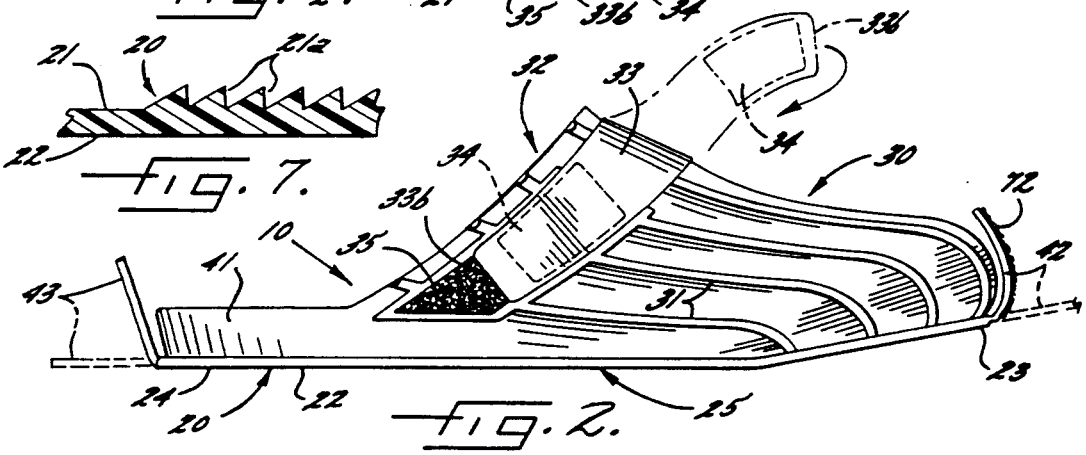
Fig. 2.
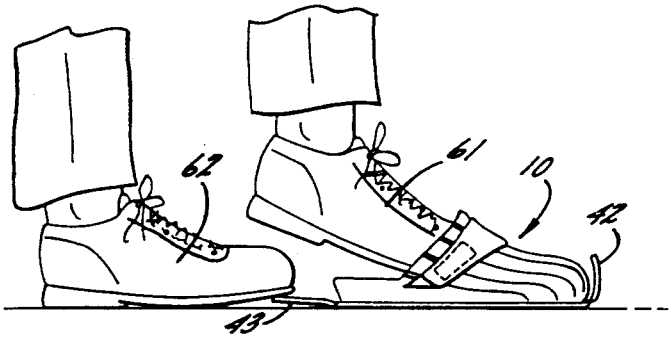
Fig. 3.
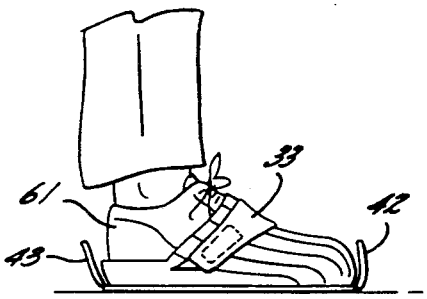
Fig. 4.
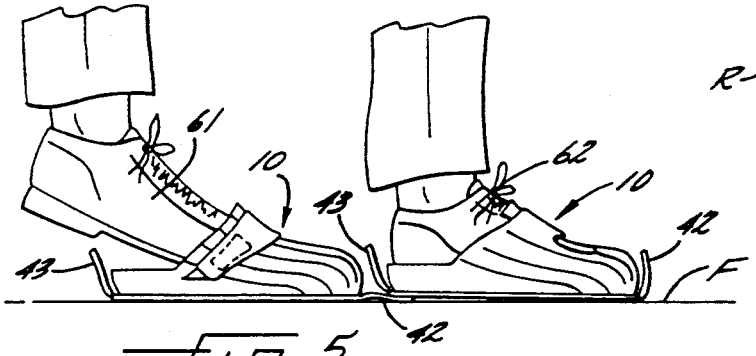
Fig. 5.
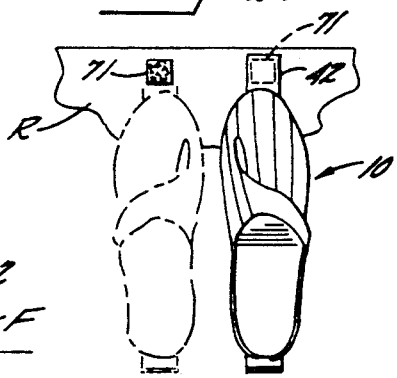
Fig. 6.

OVERSHOES FOR PROTECTING CLEAN FLOORS FROM SOILED SHOES OR BOOTS

FIELD OF THE INVENTION

This invention relates to overshoes for wearing over boots, shoes, and the like.

BACKGROUND OF THE INVENTION

Outdoor work, such as yard work, etc. often requires walking through mud, dirt, puddles and other debris that may become attached to a persons shoes. At times, when performing the outdoor work, there is a need to go into a house or building, which is relatively clean, to answer a telephone, get a tool, take a work break, etc. When these situations arise, the person performing the outdoor work is faced with the alternatives of entering the house with soiled shoes or removing the shoes or boots. If the need to enter the house is to answer a phone or other exigency, there may not be time to remove the shoes, particularly if the person is wearing laced up boots. If there is time to remove the shoes, the wearer sometimes will get mud on his hands, clothes or other inconvenient places which may be accidentally deposited in the house. Further, when leaving the house the wearer has to stop and take the time to put the shoes back on. This will become very annoying and a waste of time if the person has to repeatedly go inside the house while conducting the outdoor work.

U.S. Pat. No. 3,399,470 to Schofield discloses an overshoe in the form of a terry cloth bag with an elastic hem at the top portion thereof. The overshoe is designed so that one size fits all. However, this does not provide a satisfactory solution to the problem discussed above. The Schofield overshoe must be slipped over the toe of the shoe with one or both hands and stretching the elastic around the heel. If the shoe has substantial amount of mud on it, it is likely that the mud will get on the hand while attaching the overshoe. Further, this would be very inconvenient to a person entering the house carrying an object with both hands. Also, when hurrying to answer the telephone, the process of picking up the terry cloth overshoe, determining where the toe is, and standing on one foot while slipping it over the other would be likely to consume the time that the wearer has to get to the phone.

U.S. Pat. No. 3,084,459 to Colman discloses a shoe cover for wearing over a shoe for the prevention of lint contamination in a clean room such as where precision equipment is assembled. The shoe cover is comprised of woven fabric and completely surrounds the shoe. This type of shoe cover would be unsuitable for covering muddy shoes for a quick errand because it would be difficult to attach and remove quickly. Moreover, the overshoe is intended to be used regardless of how clean or dirty the shoes are.

It is more conventionally known to provide overshoes to protect the shoes from the elements such as rain and mud rather than to protect the floor from the shoes. For example, U.S. Pat. No. 3,283,423 to Schovee discloses a mens rubber with a flexible tab disposed from the heel. By stepping on the tab, the heel of the overshoe tilts to open to receive a shoe into the toe portion of the overshoe. However, as Schovee discloses, this is for protection of the shoe.

Accordingly it is the object of the present invention to provide an overshoe which avoids the disadvantages of the prior art as discussed above.

It is a more particular object of the present invention to provide an overshoe for protecting the relative clean interior spaces of a house from mud and soil that may otherwise be carried in from the outdoors by shoes or boots.

It is a further object of the present invention to provide an overshoe which is simple and easy to use and which is easily attached and removed from a shoe or boot in a quick and simple hands free manner.

SUMMARY OF THE INVENTION

The above and other objects are achieved by the present invention of a overshoe including a sole having an inside wall, an outside wall, a heel portion, an arch portion, and a toe portion. The overshoe further includes an upper portion attached to the edge of the sole and disposed substantially over the arch and toe portions of the sole so that the sole and upper portion are adapted to overlie a shoe or boot. An upstanding lip is attached to the edge of the heel portion of the sole and extends upwardly a distance less than the height of the upper portion. The upstanding lip further extends around the edge of the heel portion for receiving the heel of a shoe or boot. The heel thereby retains mud or dirt inside the overshoe that may become separated from the shoe or boot. Accordingly a dirty or muddy shoe or boot may be easily inserted into the overshoe so that the overshoe will be removably attached to the shoe or boot and mud and dirt separated from the shoe or boot will remain in the overshoe.

The overshoe may further include an adjustable strap extending transversely over the upper portion to provide an adjustment for different shoes or boots. Also, lips may be provided at the heel and toe portions to provide a convenient means of fixing the overshoe to the floor while attaching or removing the overshoe.

BRIEF DESCRIPTION OF THE DRAWINGS

Some of the objects of the invention have been stated and other will appear as the description proceeds when taken in conjunction with the accompanying drawings in which:

FIG. 1 is a top view of an overshoe for the right foot embodying the features of the present invention;

FIG. 2 is a side elevation view of the overshoe;

FIG. 3 is a side view of the overshoe illustrating the overshoe being attached onto the shoe of a wearer in a hands free operation;

FIG. 4 is a side view illustrating the overshoe attached on the shoe of the wearer;

FIG. 5 is a side view illustrating the overshoe being removed from the shoe of a wearer in a hands free operation;

FIG. 6 is a fragmentary side elevation view of the overshoe suspended by a hanger on a wall; and FIG. 7 is an enlarged fragmentary cross sectional view taken along line 7—7 in FIG. 1.

DETAILED DESCRIPTION OF THE PREFERRED EMBODIMENT

FIGS. 1 through 7 illustrate a preferred embodiment of an overshoe comprising the present invention which is generally indicated by the numeral 10. The overshoe 10 is sized and proportioned to fit over a shoe or boot while the shoe or boot (hereafter referred to generically as a shoe) is worn by a wearer. The overshoe 10 is preferably manufactured and used in left and right pairs to be worn over the shoes on the left foot and right foot of a wearer.

Accordingly, the overshoe has the general shape of a foot and from the top view as shown in FIG. 1 has an elongate contoured shape. In FIGS. 1–4, there is illustrated only a right overshoe and while the description focuses on the illustration, it should be understood that the overshoe 10 includes a complementary left overshoe as well.

The overshoe 10 more particularly comprises a sole 20 which extends the length of the overshoe 10 and is designed to support the shoe above the ground. The sole 20 includes a generally flat inside wall 21 (FIG. 7) along the upper surface thereof and a generally flat outside wall 22 along the lower surface thereof for contacting the ground. The sole 20 further comprises a forward toe portion 23 at the forward end of the sole 20, a rearward heel portion 24 at the opposite end of the sole 20. An arch portion 25 is positioned generally intermediate of the toe portion 23 and the heel portion 24. The sole 20 also includes an elongate contoured inside edge 26 and an elongate contoured outside edge 27 forming opposite side edges of the elongate sole 20.

An upper portion, generally indicated by the numeral 30, is attached to the sole 20 so as to substantially overlie the toe portion 23 and the arch portion 25 of the inside wall 21 in a spaced relationship. More particularly the upper portion is attached to the edge of the sole 20 extending approximately from the arch portion 25 at the inside edge 26 around to the toe portion 23 and back around to the arch portion 25 at the outside edge 27. The upper portion 30 therefore forms a hoodlike sheath spaced from and overlying the sole 20 to receive and overlie the toe and forward portions of a shoe. An opening 32 (FIG. 2) is provided in which the toe and forward portions of a shoe may be inserted when attaching the overshoe 10.

The overshoe 10 of the present invention is adapted to be attached to a shoe that has mud or other soil adhering thereto. One purpose of the overshoe 10 is, therefore, to prevent or limit the extent to which the soil or mud may be detached from the shoe and be deposited onto floors, carpets, walls or other inconvenient places. Accordingly, an upstanding lip 41 is attached to the edge of the heel portion 24 of the sole 20. The upstanding lip 41 is positioned generally in conjunction with the upper portion 30 so as to in combination, retain any loose or detached mud from the shoe. The upstanding lip 41 more particularly extends around the edge of the sole 20 from the upper portion 30 at the inside edge 26 around the heel portion 24 to the upper portion 30 at the outside edge 26. This upstanding lip 41 further provides the heel portion 40 with added rigidity and therefore maintains the heel portion 24 in close proximity with the heel of the shoe. As will be more particularly explained below, the upstanding lip 41 may include a space or gap **41*a* at the extreme rear edge of the sole 20. The upstanding lip 41 is further arranged to have an upward extension less than the upward extension of the upper portion 30 so as to provide and maintain a large unobstructed opening 32**.

To accommodate different shoes having different outer dimensions, such as a sneaker compared to a steel toe boot, the overshoe 10 includes a longitudinal slot 36 in the upper portion 30 to allow the spacing of the upper portion 30 from the sole 20 to readily increase or decrease. The longitudinal slot has opposite edges which may be spaced apart or overlapped to form varying dimensions between the upper portion 30 and the sole 20. An adjustment strap 33 having a fixed end **33*a* and a free end 33*a*, extends traversely over the upper portion 30 from a fixed end 33*a* at one side of slot 36 across the slot 36 to the other side to provide a secure adjustment of the spacing of the upper portion 30 from the sole 20 and to securely retain a shoe in the overshoe 10. The adjustment strap 33 may be adjusted by any conventional or known means at the free end 33*b* such as a buckle, etc. In the preferred embodiment, the strap 33 includes hook and loop fastener means 34 and 35 otherwise known as "Velcro." More particularly, a segment 34 of hook type material is mounted to the underside of the strap 33 to engage an elongate segment 35 of loop material. The overshoe 10 may therefore be secured onto the shoe of the wearer by simply pulling the strap 33 taut and pressing the segment 34 onto the segment 35. To further facilitate the attachment of the overshoe 10 to a shoe upstanding gripping means in the form of, a series of ridges 21*a* (FIG. 7) are provided along the inside wall 21 of the sole 20. The ridges 21*a* preferably are angled toward the toe portion 23 so as to frictionally engage the bottom of a shoe and prevent it from sliding in the overshoe 10. The ridges 21*a* are preferably along the entire surface of the inside wall 21. However, the ridges should be at least coincident with the arch and toe portions 25 and 23**.

The preferred embodiment of the overshoe 10 further includes restraining means in the form of flexible tabs 42 and 43 positioned at opposite ends of the sole 20. More precisely, the tab 42 is secured to the front edge of the toe portion 23 so as to extend generally vertically upward therefrom above the height of said lip 41. The tab 43 is similarly attached to the rearmost edge of the heel portion 24 so as to extend generally vertically upward therefrom above the height of said lip 41. Each of the upstanding tabs 42 and 43 is adapted to flex downwardly at the juncture of the sole 20 as illustrated in broken lines in FIG. 2.

The ability of the tabs 42 and 43 to freely flex, and also by virtue of their position on the sole, facilitates a hands free attachment or detachment of the overshoe 10 from a shoe of a wearer. Referring to FIG. 3, the overshoe 10 has a generally large opening 32 in which to insert the shoe 61. However, it is likely that the overshoe 10 would slide along the floor F before the shoe 61 is completely received into the opening 32. To prevent the overshoe 10 from sliding along the floor F, the overshoe 10 may be restrained from movement by the tab 43 with the other shoe 62. The wearer would simply step on the tab 43 with the other shoe 62, engaging the tab 43 between the floor and the bottom of the shoe 62. Accordingly the overshoe 10 is fixed or held in place and prevented from moving forwardly. The shoe 61 then may be easily inserted into the opening 32 to the toe portion 23 and have the heel of the shoe 61 nest down within the upstanding lip 41. The adjustable strap 33 may then be adjusted and secured or may be previously adjusted for the shoes. FIG. 4 best illustrates the overshoe 10 attached to a shoe. Once the overshoe 10 is attached, the tabs 42 and 43 extend vertically upright so as not to interfere with walking, etc.

When it is desired to remove the overshoes, the tab 42 may then be gripped as illustrated in FIG. 5 to provide easy, hands free extraction of the shoe 61. The wearer simply steps onto the tab 42 and retains it between the shoe 62 and the floor F. Accordingly, the overshoe 10 is fixed or held in place and the shoe 61 may be withdrawn.

It should be apparent that the hands free attachment and detachment feature of the overshoes of the present invention is quick and easy and provides an effective solution to a problem that would otherwise be annoying and problematic. Attaching and removing the overshoes from the shoes or boots is very easy, simple and quick without involving any stooping or bending or the necessity of manipulating the overshoe onto the shoe or boot.

The tab 42 provides a further feature in the preferred form of the invention wherein the tab 42 is provided with fastener means so that the overshoes are preferably suspended from a hanger or rack so as not to clutter an entry way to the house. More particularly, as illustrated in FIG. 6, the overshoes 10 are suspended by a hook and loop type fastener wherein one fastener segment 71 is attached to a wall or rack R. A cooperating fastener segment 72 of the hook and loop fastener is attached to the front side of tab 42 so as to engage the wall mounted fastener segment 71.

The overshoe is preferably made of a unitary construction from a rubber or plastic material so as to be easily washable. For example, the overshoe 10 may be washed with a jet spray from a common garden water hose. The rubber or plastic is preferably flexible and stretchable so as to accommodate and conform to various shaped shoes while not being so stretchable that the overshoes may easily fall off the shoe. In that regard, to provide the upper portion 30 with greater stability and to prevent the upper portion from sagging downwardly, a series of ribs 31 are provided thereon. The ribs 31 provide more body and resilience to the upper portion 30 and increases the rigidity of the entire overshoe 10. The overshoe 10 may serve a variety of needs such as for homeowners and lawn care personnel. However, it may also have industrial applications where individuals work in a dirty environment with adhering materials such as oil or tar and then have a need to enter a clean environment such as a lunchroom or office area. For such needs the overshoe would be formed of flexible material resistant to such chemicals.

In the drawings and specification there has been set forth a preferred embodiment of the invention, and although specific terms are employed they are used in a generic and descriptive sense only and not for purposes of limitation.

That which is claimed is:

1. An overshoe for wearing over dirty or muddy shoes, boots and the like indoors and characterized by the ability to keep the dirt or mud from being deposited indoors, particularly on floors, carpets and walls, and comprising a sole having an inside wall and an outside wall and a heel portion, an arch portion and a toe portion, an upper portion attached to the edge of said sole and disposed substantially over said arch and toe portions of said sole so that said sole and upper portion are adapted to overlie the shoe or boot, an upstanding lip attached to the edge of said heel portion of said sole and extending upwardly a distance less than the height of said upper portion and extending around the edge of said heel portion for receiving the heel of the shoe or boot and retaining mud or dirt inside the overshoe that becomes separated from the shoe or boot, said upstanding lip having a gap in the rearmost portion thereof, and restraining means attached to at least one of said heel and toe portions for being stepped upon to restrain movement of the overshoe for facilitating insertion or removal of the shoe or boot, said restraining means extending upwardly to a height above said lip so as to be readily accessible for being stepped upon whereby, a dirty or muddy shoe or boot can be easily inserted into the overshoe so that the overshoe will be removeably attached to the shoe or boot and mud and dirt separated form the shoe or boot will remain in the overshoe.

2. An overshoe for wearing over dirty or muddy shoes, boots and the like indoors and characterized by the ability to keep the dirt or mud from being deposited indoors, particularly on floors, carpets and walls, and comprising a sole having an inside wall and an outside wall and a heel portion, an arch portion and a toe portion, the portion of said inside wall coincident with said arch and toe portions includes upstanding gripping means for frictionally engaging the bottom of the shoe or boot, an upper portion attached to the edge of said sole and disposed substantially over said arch and toe portions of said sole said upper portion including a longitudinal slot having opposing edges, an adjustment strap extending transversely over said slot, said adjustment strap having a free end and a fixed end attached to said upper portion on one side of said slot, and attachment means for releasably attaching the free end of said adjustment strap to said upper portion on the other side of said slot so that said sole and upper portion are adapted to frictionally engage the shoe or boot, an upstanding lip attached to the edge of said heel portion of said sole and extending upwardly a distance less than the height of said upper portion and extending around the edge of said heel portion for receiving the heel of the shoe or boot and retaining mud or dirt inside the overshoe that becomes separated from the shoe or boot, said upstanding lip having a gap in the rearmost portion thereof, and whereby, a dirty or muddy shoe or boot can be easily inserted into the overshoe so that the overshoe will be removeably attached to the shoe or boot and mud and dirt separated form the shoe or boot will remain in the overshoe.

3. The overshoe as defined in claim 2 further comprising restraining means attached to one of said heel portion and said toe portion for being stepped upon to restrain movement of the overshoe for facilitating insertion and removal of the shoe or boot.

4. The overshoe as defined in claim 3 wherein said attachment means includes one component of a hook and loop type fastener means mounted to the free end of said strap, and the other component of a hook and loop type fastener means mounted to said upper portion.

5. The overshoe as defined in claim 3 wherein said gripping means comprises a series of ridges extending upwardly from said sole and toward the toe portion of said sole.

6. The overshoe as defined in claim 3 wherein said restraining means comprises a flexible tab extending from the toe portion of said sole, the flexible tab being oriented substantially vertically when not in use.

7. The overshoe as defined in claim 3 wherein said restraining means comprises a flexible tab extending from the heel portion of said sole, said flexible tab being oriented substantially vertically when not in use.

8. The overshoe as defined in claim 3 wherein said restraining means is attached to both said heel portion and said toe portion and comprises flexible tabs extending from said heel portion and said toe portion, said flexible tabs being oriented substantially vertically when not in use and extending upwardly to a height above said lip so as to be readily accessible for being stepped upon.

* * * * *